US009360266B2

(12) United States Patent
Raczek et al.

(10) Patent No.: US 9,360,266 B2
(45) Date of Patent: Jun. 7, 2016

(54) CANNON AND MILITARY VEHICLE

(75) Inventors: Matthias Raczek, Kassel (DE); Jens Koester, Kassel (DE); Matthias Czok, Kassel (DE)

(73) Assignee: KRAUSS-MAFFEI WEGMANN GMBH & CO. KG, Munich (DE)

( * ) Notice: Subject to any disclaimer, the term of this patent is extended or adjusted under 35 U.S.C. 154(b) by 0 days.

(21) Appl. No.: 14/119,182

(22) PCT Filed: May 15, 2012

(86) PCT No.: PCT/DE2012/100140

§ 371 (c)(1),
(2), (4) Date: Sep. 16, 2014

(87) PCT Pub. No.: WO2012/159619

PCT Pub. Date: Nov. 29, 2012

(65) Prior Publication Data

US 2015/0075358 A1 Mar. 19, 2015

(30) Foreign Application Priority Data

May 20, 2011 (DE) ..... 10 2011 050 537

(51) Int. Cl.

| | |
|---|---|
| ***F41G 3/00*** | (2006.01) |
| ***F41A 23/24*** | (2006.01) |
| ***F41A 23/28*** | (2006.01) |
| ***F41A 23/30*** | (2006.01) |

(Continued)

(52) U.S. Cl.

CPC ..... *F41A 23/24* (2013.01); *F41A 23/28* (2013.01); *F41A 23/30* (2013.01); *F41A 23/34* (2013.01); *F41A 27/00* (2013.01)

(58) Field of Classification Search

CPC ..... F41H 5/20; F41A 23/00; F41A 23/24; F41A 23/26; F41A 23/28; F41A 23/30; F41A 23/34; F41A 23/50; F41A 23/56; F41A 27/00; F41A 27/18

USPC ..... 89/36.07, 36.08, 36.09, 36.13, 40.03, 89/40.09, 40.11

See application file for complete search history.

(56) References Cited

U.S. PATENT DOCUMENTS

| | | | | |
|---|---|---|---|---|
| 1,249,542 | A | 12/1917 | Spence | |
| 1,333,446 | A * | 3/1920 | Ross | 89/40.03 |
| 2,361,129 | A * | 10/1944 | Sheehan et al. | 89/36.08 |

(Continued)

FOREIGN PATENT DOCUMENTS

| | | |
|---|---|---|
| DE | 2235728 | 1/1974 |
| DE | 3247271 | 7/1984 |

(Continued)

OTHER PUBLICATIONS

Definition of "on". American Heritage® Dictionary of the English Language, Fifth Edition. Copyright © 2011 by Houghton Mifflin Harcourt Publishing Company. Published by Houghton Mifflin Harcourt Publishing Company.*

(Continued)

*Primary Examiner* — Gabriel Klein
(74) *Attorney, Agent, or Firm* — Thompson Hine LLP

(57) ABSTRACT

A cannon and a military vehicle having such a cannon, which includes a support, a turret that is rotatable relative to the support and is provided with an opening, and a closure element disposed on the support and configured for the closing off of the opening of the turret.

15 Claims, 4 Drawing Sheets

(51) Int. Cl.
*F41A 23/34* (2006.01)
*F41A 27/00* (2006.01)

(56) References Cited

U.S. PATENT DOCUMENTS

| | | | | | |
|---|---|---|---|---|---|
| 2,559,714 | A * | 7/1951 | Duplessis | 89/37.01 |
| 3,559,527 | A * | 2/1971 | Schallehn | 89/36.08 |
| 3,722,357 | A * | 3/1973 | Schallehn | 89/36.08 |
| 4,065,999 | A | 1/1978 | Hultgren et al. | |
| 4,733,596 | A * | 3/1988 | Crow et al. | 89/34 |
| 4,852,461 | A | 8/1989 | von Laar et al. | |
| 5,284,082 | A * | 2/1994 | Sprafke et al. | 89/36.13 |
| 5,558,384 | A | 9/1996 | Mouterde et al. | |
| 5,728,966 | A * | 3/1998 | Bobinger et al. | 89/46 |
| 6,457,396 | B1 * | 10/2002 | Bean et al. | 89/40.04 |
| 2006/0162541 | A1 | 7/2006 | Heldmann et al. | |
| 2006/0225567 | A1 | 10/2006 | Balbo | |
| 2011/0219944 | A1 * | 9/2011 | Adorni et al. | 89/36.13 |
| 2012/0325075 | A1 * | 12/2012 | Raczek et al. | 89/33.1 |
| 2014/0206941 | A1 * | 7/2014 | Stiner et al. | 600/205 |

FOREIGN PATENT DOCUMENTS

| | | | |
|---|---|---|---|
| DE | 4324966 | 1/1995 | |
| DE | 10003823 | 8/2001 | |
| DE | 102004025743 | 12/2005 | |
| DE | 102008053153 | 4/2010 | |
| FR | 1358796 | 4/1964 | |
| GB | 1040323 | 8/1966 | |
| GB | 1378467 | 12/1974 | |
| JP | 2003336998 | 11/2003 | |
| WO | WO 03025494 A1 * | 3/2003 | F41H 7/02 |

OTHER PUBLICATIONS

PCT, International Search Report, Application No. PCT/DE2012/100140 (Nov. 29, 2012).

* cited by examiner

CANNON AND MILITARY VEHICLE

The instant application should be granted the priority dates of May 20, 2011, the filing date of the corresponding German patent application 10 2011 050 537.7, as well as May 15, 2012, the filing date of the International patent application PCT/DE2012/100140.

BACKGROUND OF THE INVENTION

The invention relates to a cannon having a support and a turret that is mounted so as to be rotatable relative to the support, wherein the turret has a closable opening. The invention also relates to a military vehicle having a cannon that is provided with a support and a turret that is mounted so as to be rotatable relative to the support, wherein the turret has a closable opening.

Cannons having large caliber weapons, such as artillery cannons, howitzers or tanks, generally have a turret that is rotatably disposed on a support, and in which the weapon is accommodated such that it can be adjusted in azimuth and elevation.

The turret generally has a closed configuration, so that the components disposed within the turret, for example partially automatically operating loading devices, etc., are protected from weather influences and dirt. To provide the operator access to the interior of the turret, the turret generally has a closable opening, for example in the form of a rear hatch that is connected to the turret. By opening the rear hatch, access to the interior of the turret is provided for the operator, for example to operate the weapon, to load ammunition into the interior of the turret, to carry out necessary maintenance activities from time to time, etc. Due to the fact that the opening is disposed somewhat high above the ground, it may additionally be necessary after opening the hatch for the operator to use a climbing aid, for example in the form of a ladder, in order to be able to enter the interior of the turret.

To dissipate the somewhat considerable recoil forces that result when firing ammunition, the support that carries the turret is frequently additionally supported relative to the ground via hydraulically actuatable support mechanisms prior to firing the ammunition.

With such cannons, the operator must therefore initially undertake a number of preparations before the cannon is in a combat ready state. First of all, the support mechanisms for supporting the support are actuated. Subsequently, the opening of the turret is opened, whereupon the operator, possibly with the aid of a climbing aid that has to be placed against the opening, can then enter the interior of the turret and only then can the weapon be operated.

It is therefore an object of the present invention to simplify the actions that have to be carried out during conversion of the cannon into a combat ready state.

SUMMARY OF THE INVENTION

With a cannon of the aforementioned type, this object is realized in that the opening is closable by means of a closure element that is disposed on the support.

By means of the closure element disposed on the support, the processes during conversion into a combat ready state can be simplified, since after opening of the turret opening, the closure element can serve as a support and/or climbing aid. In this way, at the same time that the opening is opened, a support and/or climbing aid is provided, without for this purpose having to carry out separate preparations. With few steps, the cannon can be rapidly converted to a combat ready state.

Pursuant to a particularly advantageous embodiment, the closure element can be movable back and forth between an open position and a closed position, whereby in the open position the closure element forms a support that supports the support relative to the ground. The closure element can be hydraulically movable, and in the opened position can form a support for the dissipation into the ground of the firing reaction forces that occur upon firing of ammunition.

Pursuant to one structurally advantageous embodiment, the closure element is connected to the support in such a way as to be pivotable. The closure element can be pivotably connected with the support via an articulation or hinged joint.

In conjunction with the above, it is furthermore structurally advantageous if the closure element is pivotable about an axis that in an index position of the turret is disposed transverse to the gun bore axis of the weapon that is mounted in the turret. In the index position, the weapon, i.e. its gun bore axis, is disposed centrally over the support, wherein the azimuth adjustment angle is 0°. In this position, the cannon assumes a compact position that is suitable for conveyance or marches. Due to the pivot axis being oriented transverse or perpendicular thereto, an opening that is disposed at the rear of the turret can be closed.

Pursuant to a further advantageous embodiment, in the index position of the turret the opening can be closed off by the closure element. For transport, a turret can be released into a prescribed index position in which the opening is oriented relative to the closure element in such a way that it can be closed off by the closure element. Upon opening of the opening, the closure element pivots out of the rotational configuration or contour of the turret, so that the turret can subsequently be adjusted or aimed in the azimuthal direction.

To facilitate access by the operator into the interior of the cannon, it is particularly advantageous if the closure element, in the opened position, forms an ascension to make climbing into the turret easier. It is now no longer necessary for the operator to first, in a separate preparation step, obtain a climbing aid, and to position it in the region of the opening. The ascension can be disposed on the inner side of the closure element, and pursuant to one structural embodiment can be in the manner of a stairs or ladder.

The closure element is preferably provided with an equipment compartment for accommodating equipment, thereby making available additional storage space. Pursuant to a particularly favorable embodiment, the equipment compartment is accessible from the outer side of the turret in the open position of the closure element.

For transport of the cannon, it is advantageous if the support is embodied as a transport platform, so that the cannon, in the manner of a standardized transport container, can be loaded and transported by means of an appropriate transport vehicle.

With a military vehicle of the aforementioned type, the object of the invention is realized in that the opening can be closed off by a closure element that is disposed on the support.

By means of the closure element disposed on the support, the processes during conversion of the cannon into a combat ready state can be simplified, since after opening of the turret opening the closure element can serve as a support and/or climbing aid. In this way, along with the opening of the opening a support and/or climbing aid is achieved at the same time, without for this purpose having to carry out separate preparations. The cannon can be rapidly converted into a combat ready state with a few steps. With the inventive vehicle, it is furthermore possible to utilize all of the embodiments described in conjunction with the inventive cannon.

It is furthermore proposed that the support be disposed on a loading surface of the vehicle. In this connection, the support, in the manner described previously, can be embodied in the manner of a transport platform that is removable from the loading surface or can be integral with the transport vehicle, for example in the form of a chassis or support that is fixedly connected with the frame of the vehicle.

BRIEF DESCRIPTION OF THE DRAWINGS

Further advantages and particulars of the invention will be explained in detail subsequently with the aid of the exemplary embodiment that is illustrated in the drawings, in which.

DESCRIPTION OF SPECIFIC EMBODIMENTS

Figure 1:
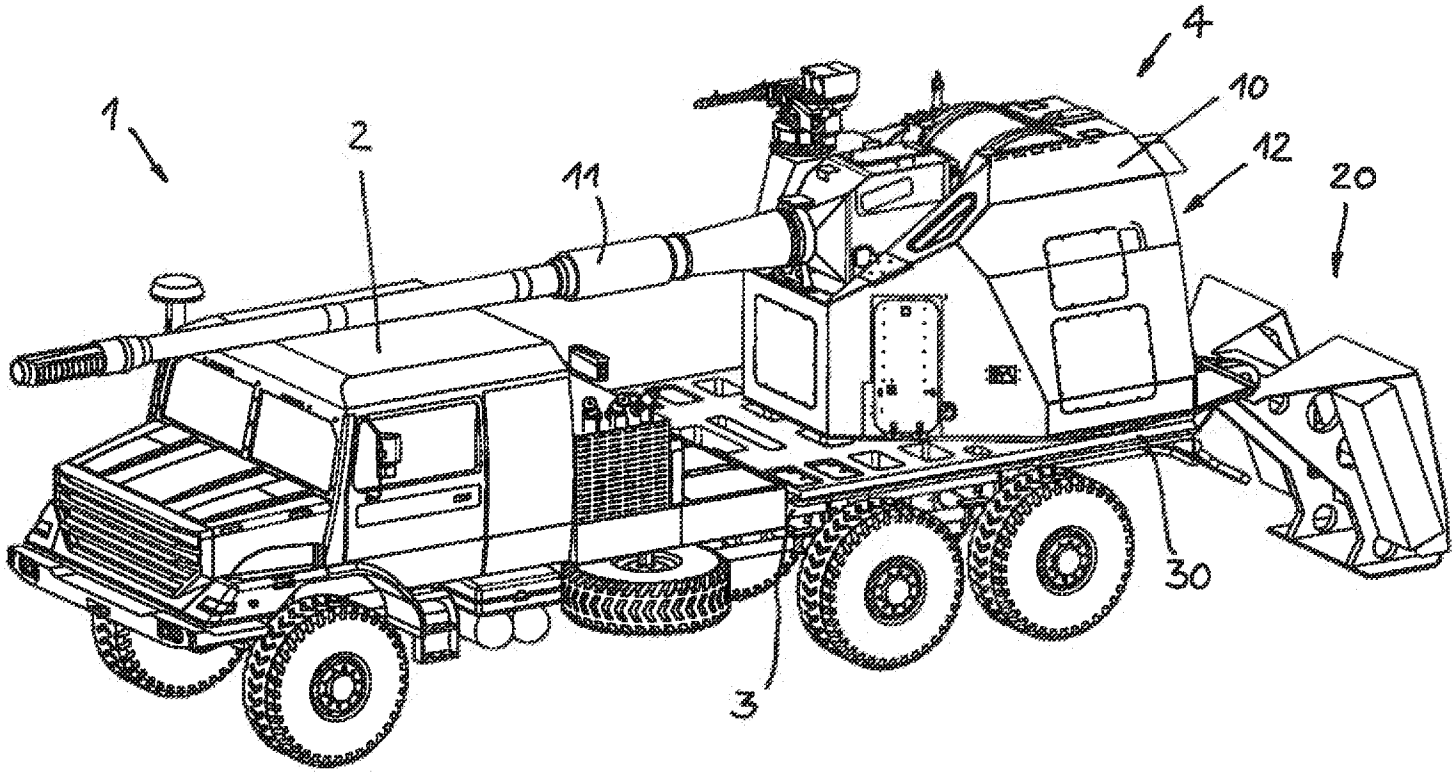
FIG. 1 is a perspective illustration of a military vehicle having a cannon in its index position.

FIG. 1 illustrates a military vehicle 1 that is configured as a transport vehicle and that has a driver's cabin 2 as well as a loading surface 3, disposed in the region behind the driver's cabin 2, for receiving loads. An ordinance or cannon 4, in the form of a so-called light cannon, is accommodated in the region of the loading surface 3; during firing, the cannon must be braced to dissipate the resulting discharge reaction forces.

The cannon 4 is comprised of a tower or turret 10 that is disposed above a chassis or support 30 and that is mounted so as to be rotatable relative to the support 30; a weapon 11 is mounted in the turret such that it can be adjusted in elevation and azimuth. The turret 10 and support 30 thus form a mounting of the cannon 4.

In the position illustrated in FIG. 1, the cannon 4 is in an index position, in which the turret 10, i.e. the gun bore axis R of the weapon 11, is oriented parallel to the longitudinal axis of the vehicle 1, or to the longitudinal axis of the support 30. In the index position, the cannon 4 assumes a compact position, making this position particularly suitable for conveyance or marches.

Figure 2:
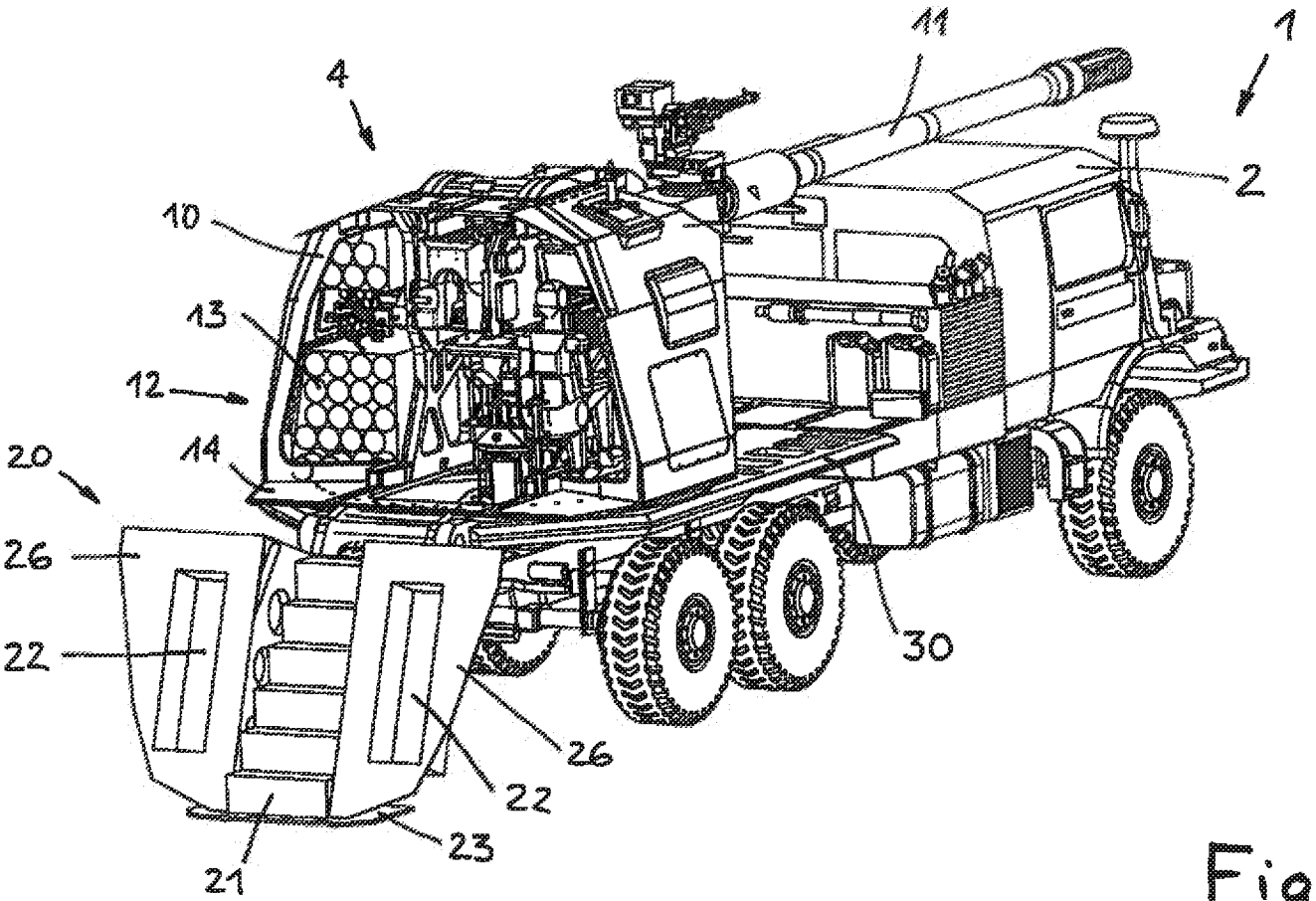
FIG. 2 is a perspective illustration of a further view of the vehicle of FIG. 1.

As can be seen in particular from the illustration of FIG. 2, the turret 10 is open in the region of its rear side, which is disposed opposite of the weapon 11. The turret 10 has an opening 12, which extends over the entire rear side or end of the turret 10. The operator can get into the interior space 13 of the turret 10 via the opening 12. It is furthermore possible to introduce ammunition into the interior space 13 of the turret 10 through the opening 12. Disposed in the interior space 13 are magazines for storing ammunition, a partially automated loading device for loading the weapon 11, as well as control devices for controlling the cannon 4.

Figure 3:
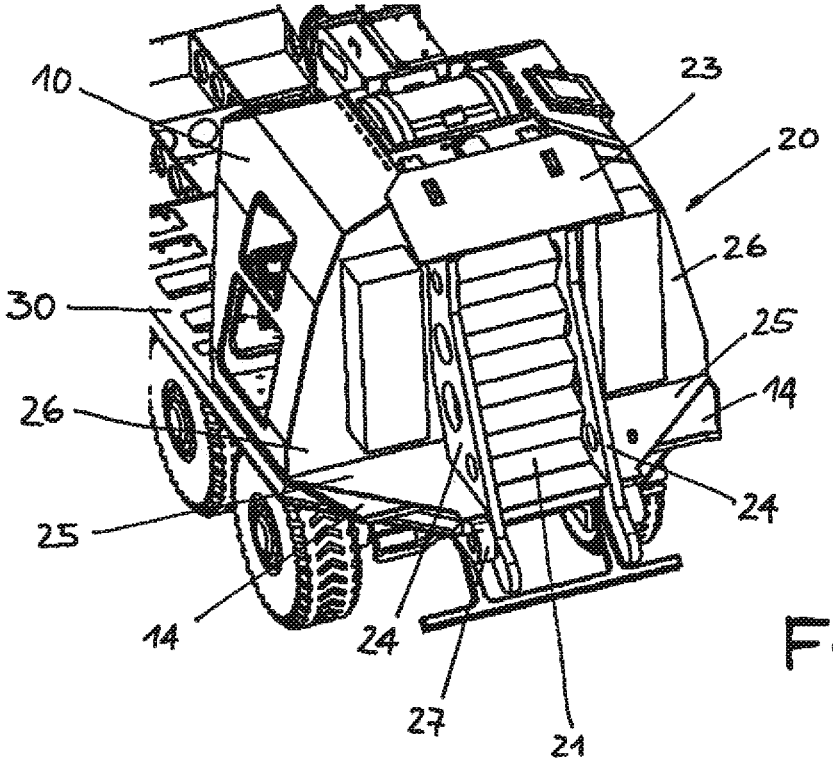
FIG. 3 is a perspective illustration of a further view of the vehicle of FIG. 1, in which the closure element is in the closed position.

To protect the interior space 13 from weather influences and dirt during transport of the cannon 4, a closure element 20 is provided that is embodied as a hatch, and which is movable back and forth between an open position and a closed position. In the closed position, the closure element 20 forms a dust-tight closure of the opening 12 of the turret 10, so that even during longer-lasting use in dusty desert regions, the interior space of the turret 10 does not become dirty or contaminated; see FIG. 3.

The closure element 20 is connected to the support 30 of the cannon 4 in such a way as to be pivotable about a pivot axis S; for this purpose, an articulation or hinged joint 27 is provided between the closure element 20 and the support 30. In order to be able to adjust or aim the weapon 11 in an azimuthal direction, it is therefore necessary to first pivot the closure element 20 out of the rotational configuration 10 and into an open position, which will be explained in greater detail subsequently.

Figure 4:
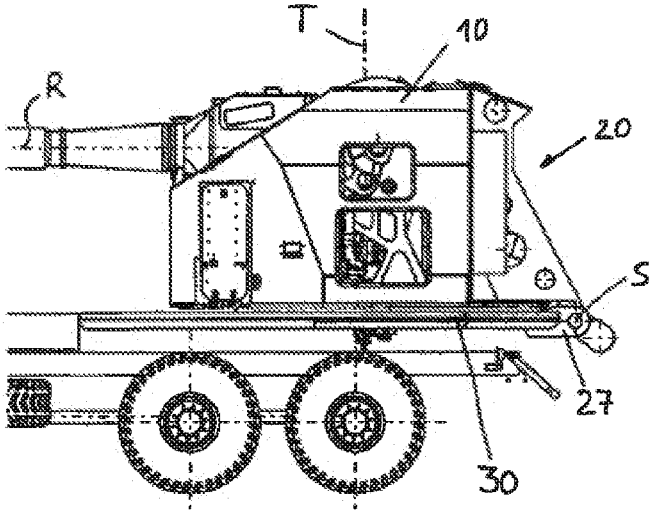
FIG. 4 is a side view of the vehicle of FIG. 3.

The turret 10 is initially in the index position. The closure element 20 is pivoted into the vicinity in front of the opening 12, and closes off the turret 10 in the manner of a tailgate; see FIG. 4. The closure element 20 is disposed within the rotational contour or configuration of the turret 10, for which reason the turret 10, in this position, cannot be rotated about the azimuth guide axis T. In this position, the cannon 4 can be brought to a site of use by the vehicle 1. In order to now make the cannon 4 ready for combat at the site of use, the closure element 20 must first be pivoted about the pivot axis S out of the rotational region of the turret 10.

Figure 5:
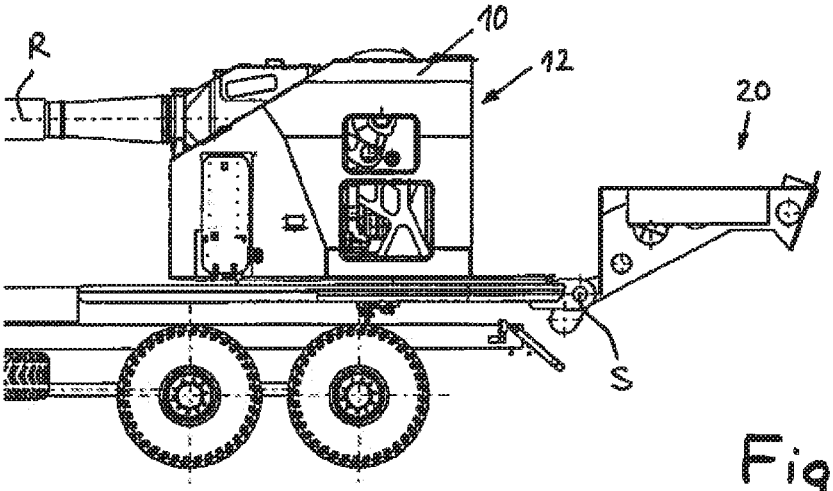
FIG. 5 is a side view of the vehicle of FIG. 4, in which the closure element is in an intermediate position.

Pivoting of the closure element 20 out of its closed position is effected via a non-illustrated drive mechanism, which due to the considerable weight of the closure element 20 has a hydraulic configuration. By actuating the drive mechanism, the closure element 20 is initially brought into the intermediate position shown in FIG. 5, in which the opening 12 is uncovered, and the closure element is now only partially in the rotational contour of the turret 10. In this intermediate position, an azimuth adjustment movement of the turret 20 is already possible in a limited angular range.

To place the cannon 4, for firing, in a state of combat readiness, it is additionally necessary, for dissipation of the resulting discharge reaction forces, to provide a support of the support 30 relative to the ground, since with light cannons 4 the mass of the support 30, in contrast, for example, to chain-driven tanks or armored howitzers, is not adequate for absorbing the resulting recoil forces.

Figure 6:
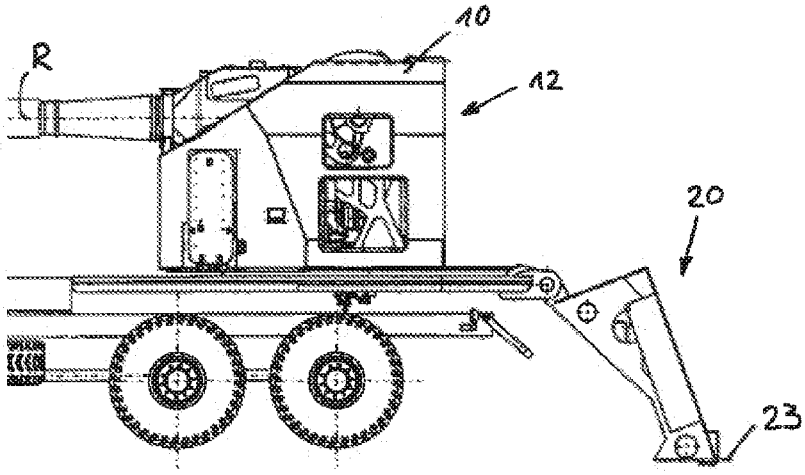
FIG. 6 is a side view of the vehicle of FIG. 4, in which the closure element is in the open position.

The required support is achieved in a straightforward manner by means of a further pivoting of the closure element 20, which is connected to the support 30, into the open position illustrated in FIG. 6, in which the closure element 20 is supported on the ground by means of the support plate 23, and forms a support for dissipation of the discharge reaction forces.

In the illustrated embodiment, the closure element 20 is disposed on the support 30 in such a way that in the index position of the turret 10, it is on the side of the turret 10 that is opposite the weapon 11, and thus forms a rear support. As a consequence of the rear support and the flat support via the support plate, which extends over approximately half of the width of the vehicle cannon, a reliable firing in an azimuthal adjustment range of the weapon of up to +/−15° out of the index position is possible.

In order to be able to reliably dissipate the somewhat considerable discharge reaction forces, the support plate 23 is connected to the articulation 27 by means of two carrier members 24 that are disposed on the closure element 20 and extend parallel to one another. The carrier members 24 are embodied as rigid steel carrier members, and can have an open or hollow cross section. To keep the mass that is to be pivoted small, in the illustrated embodiment the carrier members 24 are provided with cutouts.

As can be seen in particular from the illustration of FIG. 2, in the open position the closure element 20 not only forms a support for dissipation of the discharged reaction forces, but at the same time forms a staircase into the turret 10, which lies relatively high above the ground. For this purpose, a stairs 21 is disposed on the closure element 20 in the region between the carrier members 24; by means of the stairs, the operator can easily pass into the elevated interior space 13 of the turret 10. The stairs is disposed on the closure element 20 in such a way that in the open position the stairs is directed outwardly, thus forming a climbing aid for the operator.

The closure element 20 is furthermore provided toward both sides with sections 25, 26 that are angled off in the manner of angle irons. In the closed position, the section 25 extends approximately horizontally above the base plate 14 of the turret 10. Provided essentially perpendicular to the sections 25 are further plate-shaped sections 26 that in the closed position are oriented essentially vertically and close off the opening 12 of the turret 10 in the manner of a lid. Furthermore provided in the regions laterally adjacent to the stairs 21 are equipment compartments 22 for receiving various equipment. Additional storage room is made available by the equipment compartments 22, which in the closed position of the closure element 20 are accessible from the inner side of the turret 10, and in the open position of the closure element 20 are accessible from the outer side of the turret 10.

The cannon described above has a closure element 20 that after opening of the turret opening 12 serves as a support and a climbing aid. It is not necessary to undertake further measures for support of the support 30, nor is it necessary to place climbing aids against the cannon 4. Thus, the cannon 4 can be rapidly converted into a combat ready state merely by opening the turret opening 12 with few steps.

The specification incorporates by reference the disclosure of German 10 2011 050 537.7 filed May 20, 2011, as well as International application PCT/DE2012/100140 filed May 15, 2012.

The present invention is, of course, in no way restricted to the specific disclosure of the specification and drawings, but also encompasses any modifications within the scope of the appended claims.

REFERENCE NUMERALS

1 Vehicle
2 Driver's Cabin
3 Loading Surface
4 Ordnance or cannon
10 Tower or Turret
11 Weapon
12 Opening
13 Interior Space
14 Base Plate
20 Closure Element
21 Stairs
22 Equipment Compartment
23 Support Plate
24 Carrier Member
25 Section
27 Articulation or hinged joint
30 Chassis or Support
R Axis of Gun Bore
S Pivot Axis
T Azimuth Guide Axis

The invention claimed is:

1. A cannon (4), comprising,
a turret support (30);
a turret (10), wherein said turret is mounted on and rotatable relative to said turret support (30), and wherein said turret (10) is provided with an opening (12);
a weapon (11) mounted in the turret, the weapon having a barrel; and
a closure element (20) disposed on said turret support (30), wherein said closure element is configured for closing off said opening (12) of said turret (10), wherein said closure element (20) is movable between an open position and a closed position, and wherein in the open position said closure element (20) forms a second support for supporting said turret support (30) relative to the ground.

2. The cannon according to claim 1, wherein said closure element (20) is pivotably connected to said turret support (30).

3. The cannon according to claim 2, wherein the weapon (11) includes a gun bore axis (R), and wherein said closure element (20) is pivotable about an axis (S) that in an index position of said turret (10) extends transverse to said gun bore axis (R).

4. The cannon according to claim 3, wherein said opening (12) is closable by said closure element (20) when said turret is in the index position.

5. The cannon according to claim 1, wherein in the open position the closure element (20) forms an ascension to facilitate climbing into said turret (10).

6. The cannon according to claim 1, wherein said closure element (20) is provided with an equipment compartment (22) for accommodating equipment.

7. The cannon according to claim 1, wherein said turret support (30) is embodied as a transport platform.

8. A military vehicle, comprising:
a cannon (4) that includes a turret support (30);
a turret (10) that is mounted on and is rotatable relative to said turret support (30), wherein said turret (10) is provided with an opening (12); and
a closure element (20) that is disposed on said turret support (30) and configured for closing off said opening (12) of said turret (10), wherein said closure element (20) is movable between an open position and a closed position, and wherein in the open position said closure element (20) forms a second support for supporting said turret support (30) relative to the ground.

9. The military vehicle according to claim 8, wherein said closure element (20) is pivotably connected to said turret support (30).

10. The military vehicle according to claim 9, further comprising a weapon (11) contained in said turret (10), wherein said weapon (11) has a gun bore axis (R), and said closure element (20) is pivotable about an axis (S) that in an index position of said turret (10) extends transverse to said gun bore axis (R).

11. The military vehicle according to claim 10, wherein said opening (12) is closable by said closure element (20) when said turret is in the index position.

12. The military vehicle according to claim 8, wherein in the open position the closure element (20) forms an ascension to facilitate climbing into said turret (10).

13. The military vehicle according to claim 8, wherein said closure element (20) is provided with an equipment compartment (22) for accommodating equipment.

14. The military vehicle according to claim 8, wherein said support (30) is embodied as a transport platform.

15. The military vehicle according to claim 8, wherein said turret support (30) is disposed on a loading surface of the vehicle.

* * * * *